US006877737B2

(12) United States Patent
Yanagi et al.

(10) Patent No.: US 6,877,737 B2
(45) Date of Patent: Apr. 12, 2005

(54) SHEET FEEDING DEVICE HAVING CLEANING MODE FOR CLEANING SEPARATING MEMBER AND RECORDING APPARATUS PROVIDED WITH THE SAME

(75) Inventors: Haruyuki Yanagi, Tokyo (JP); Hiroshi Yoshino, Kanagawa (JP); Yuji Nakano, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 09/983,332

(22) Filed: Oct. 24, 2001

(65) Prior Publication Data

US 2002/0050680 A1 May 2, 2002

(30) Foreign Application Priority Data

Oct. 31, 2000 (JP) ..... 2000-333516

(51) Int. Cl.[7] ..... B65H 3/52
(52) U.S. Cl. ..... 271/121
(58) Field of Search ..... 271/121, 10.09, 271/10.11, 10.12, 109, 37, 113, 114, 116, 117, 118, 119, 122, 124, 125, 126, 127; 15/1, 93.1, 97.1, 103.5

(56) References Cited

U.S. PATENT DOCUMENTS

| | | | | | |
|---|---|---|---|---|---|
| 4,843,436 | A | * | 6/1989 | Evangelista et al. | 355/133 |
| 4,955,598 | A | * | 9/1990 | Hiroshige et al. | 271/267 |
| 5,348,283 | A | | 9/1994 | Yanagi et al. | 271/127 |
| 5,370,380 | A | | 12/1994 | Suzuki et al. | 271/21 |
| 5,474,287 | A | * | 12/1995 | Takahashi | 271/10.13 |
| 5,580,042 | A | | 12/1996 | Taniguro et al. | 271/274 |
| 5,620,174 | A | | 4/1997 | Taniguro et al. | 271/10.12 |
| 5,672,019 | A | | 9/1997 | Hiramatsu et al. | 400/624 |
| 5,918,873 | A | | 7/1999 | Saito et al. | 271/10.11 |
| 6,042,104 | A | * | 3/2000 | Nishikori et al. | 271/121 |
| 6,055,407 | A | * | 4/2000 | Inoue et al. | 399/381 |
| 6,090,463 | A | * | 7/2000 | Sakaki et al. | 428/42.1 |
| 6,131,899 | A | * | 10/2000 | Nojima et al. | 271/121 |
| 6,305,682 | B1 | | 10/2001 | Saito et al. | 271/10.11 |
| 6,338,480 | B1 | * | 1/2002 | Endo | 271/104 |
| 6,450,494 | B1 | * | 9/2002 | Adema | 271/122 |
| 6,554,512 | B2 | * | 4/2003 | Heno et al. | 400/625 |
| 6,578,841 | B2 | * | 6/2003 | Salomon et al. | 271/109 |

FOREIGN PATENT DOCUMENTS

| | | | | |
|---|---|---|---|---|
| EP | 0 801 017 | | 10/1997 | B65H/3/52 |
| EP | 0 838 418 | | 4/1998 | B65H/3/52 |
| JP | 58-82930 | | 5/1983 | B65H/3/06 |
| JP | 59-203028 | * | 11/1984 | 271/109 |
| JP | 62-167142 | * | 7/1987 | 271/109 |
| JP | 63-74841 A | * | 4/1988 | B65H/3/46 |
| JP | 63-74841 | * | 4/1988 | 271/109 |
| JP | 63-225041 | * | 9/1988 | 271/109 |
| JP | 63-300037 | * | 12/1988 | 271/125 |
| JP | 1-98536 | * | 4/1989 | 271/119 |
| JP | 1-294132 | * | 11/1989 | 271/119 |
| JP | 4-3745 | * | 1/1992 | 271/121 |
| JP | 4-72241 | * | 3/1992 | 271/109 |
| JP | 4-327434 | * | 11/1992 | 271/109 |
| JP | 5-132191 | * | 5/1993 | 271/113 |
| JP | 6-166446 | * | 6/1994 | 271/122 |
| JP | 11-314781 | | 11/1999 | B65H/3/46 |

* cited by examiner

*Primary Examiner*—Donald P. Walsh
*Assistant Examiner*—Mark J. Beauchaine
(74) *Attorney, Agent, or Firm*—Fitzpatrick, Cella, Harper & Scinto

(57) ABSTRACT

A sheet feeding device and an image forming apparatus provided with the same, has a sheet mounting part for mounting sheets, a sheets feeding part for sending out the sheets mounted on the sheet mounting part, a separator for separating the sheets one by one, and a first separating member disposed on the sheet mounting part. A cleaning mode is provided in which while the sheet feeding part is abutted against the first separating member, it is rotated for a predetermined number of revolutions so as to clean the surface of the sheet feeding part.

15 Claims, 12 Drawing Sheets

SHEET FEEDING DEVICE HAVING CLEANING MODE FOR CLEANING SEPARATING MEMBER AND RECORDING APPARATUS PROVIDED WITH THE SAME

BACKGROUND OF THE INVENTION

1. Field of the Invention

The present invention relates to a sheet feeding device and an image forming apparatus provide with the same and, in particular, to an arrangement for maintaining the performance of a sheet feeding means for feeding out sheets.

2. Related Background Art

Hitherto, in an image forming apparatus such as a printer, a copier, a facsimile device and the like, thick paper such as a postcard or an envelope, and a special sheet such as a thin plastic plate has been used in addition to a plain paper and these sheets are fed one by one by a manual feed or fed automatically and continuously by a sheet feeding device.

Such a sheet feeding device is provided with separating means for separating sheets one by one, and in such separating means, there may be used a separating claw or a separating pad. In the case of the arrangement in which sheets are separated by such separating means, an important factor for separating sheets is force for feeding out the papers by the sheet feeding means, that is, a conveying force. When this conveying force is lowered, it causes sheet feeding failure.

Incidentally, in the sheet feeding means, there may be used rubber on its surface and, as for such rubber, rubber of EPDM system and the like is used so as to secure a large frictional coefficient between the sheet and itself.

By the way, in recent years, various types of media including such as a coat paper for exclusive use of the ink jet are used and, moreover, accompanied with the spread of printers in many countries, a plain paper peculiar to each area has come to be used. For this reason, there have been strong demands for complying with various types of sheets in the field of the sheet feeding device too.

Under these circumstances, a serious problem is the adherence of coat dust of a coat paper and various paper dust to the surface of the sheet feeding means. When the paper dust adheres to the surface of the sheet feeding means in such a manner, the conveying force of the sheet feeding means is lowered to cause sheet feeding failure.

Incidentally, there may be used a cleaning sheet and the like as a countermeasure in order to remove the coat dust and the paper dust adhered to the sheet feeding means. However, when such an additional part is used, it invites an increase in cost and, since the cleaning sheet and the like is a component different from the main body, there occurs a problem that its handling becomes inconvenient.

SUMMARY OF THE INVENTION

An object of the present invention is to provide a sheet feeding device and an image forming apparatus provided with the same, which are capable of maintaining a conveying force of a sheet feeding means without using a further part.

Another object of the present invention is to provide a sheet feeding device comprising a sheet mounting means for mounting sheets, a sheet feeding means for sending out the sheets mounted on the above described sheet mounting means, a separating means for separating the sheets one by one, and a first separating member disposed on the above described sheet mounting means, said first separating member disposed at a position opposite to the sheet feeding means and contactable with the sheet mounted on said sheet mounting means, wherein a cleaning mode is provided in which while the above described sheet feeding means is abutted against the above described first separating member, it is rotated for a predetermined number of revolutions so as to clean a surface of the sheet feeding means.

Another object of the present invention is to provide a sheet feeding device comprising a sheet mounting means for mounting sheets, a sheet feeding means for sending out the sheets mounted on the above described sheet mounting means, a separating means for separating the sheets one by one, and a second separating member disposed on the above described sheet separating means, wherein a cleaning mode is provided in which while the above described sheet feeding means is abutted against the above described second separating member, it is rotated for a predetermined number of revolutions so as to clean a surface of the sheet feeding means and in the cleaning mode, said sheet feeding means is abutted against a part of the separating member where the separating member is in contact with the sheet mounted on said sheet mounting means so as to separate the sheet.

Another object of the preset invention is to provide a sheet feeding device comprising a sheet mounting means for mounting sheets, a sheet feeding means for sending out the sheets mounted on the above described sheet mounting means, a separating means for separating the sheets one by one, a first separating member disposed on the above described sheet mounting means, and a second separating member disposed on the above described separating means, wherein a cleaning mode is provided in which while the above described sheet feeding means is abutted against at least either of the first separating member and the second separating member, it is rotated for a predetermined number of revolutions so as to clean a surface of the sheet feeding means and wherein in the cleaning mode, said sheet feeding means is abutted against a part of the second separating member where the second separating member is in contact with the sheet mounted on said sheet mounting means so as to separate the sheet.

DETAILED DESCRIPTION OF THE PREFERRED EMBODIMENTS

The embodiments of the present invention will be described below with reference to the drawings.

First Embodiment

Figure 1:
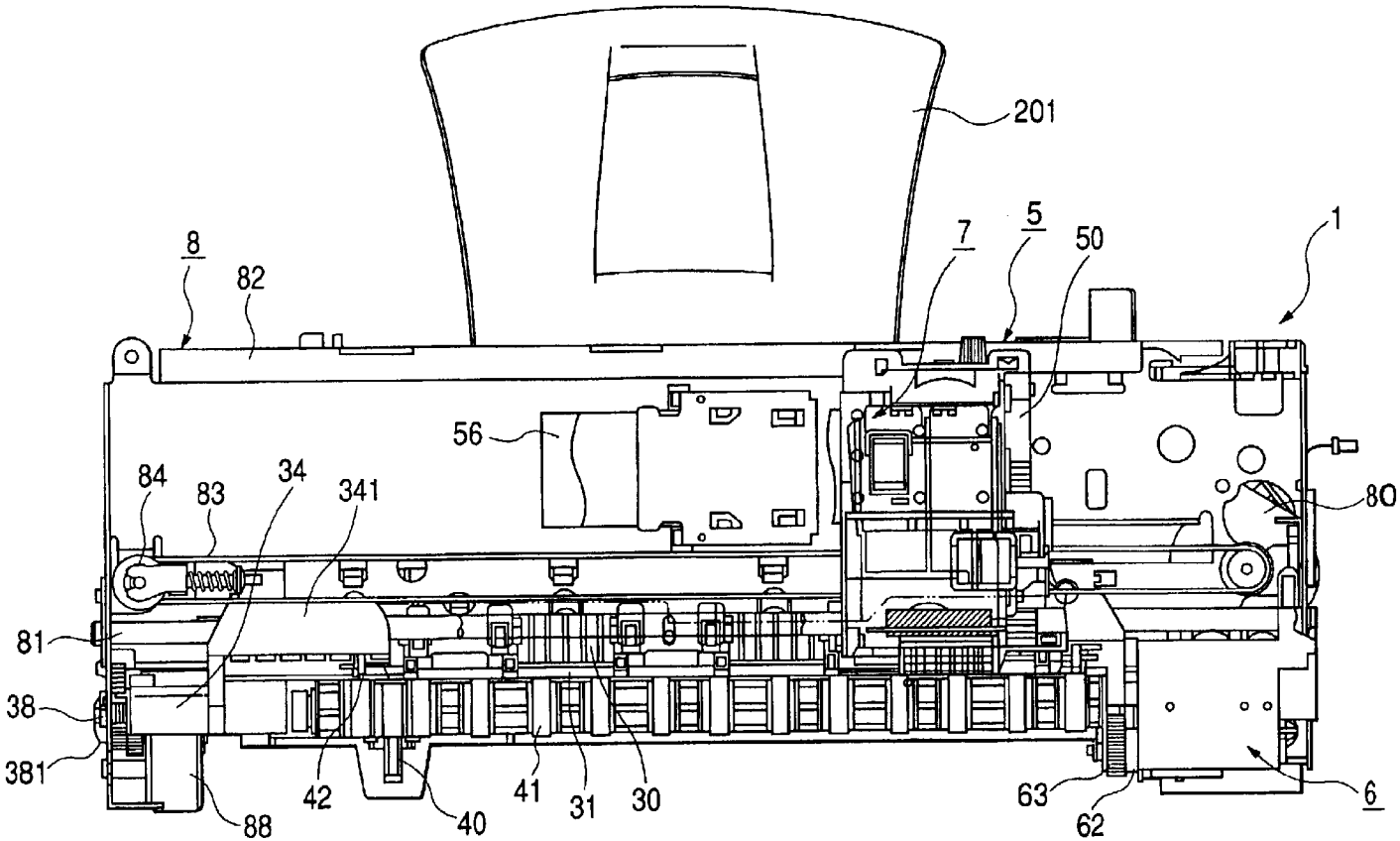
FIG. 1 is a front view of a recording apparatus which is one example of an image forming apparatus provided with a sheet feeding device according to a first embodiment of the present invention.
Figure 2:
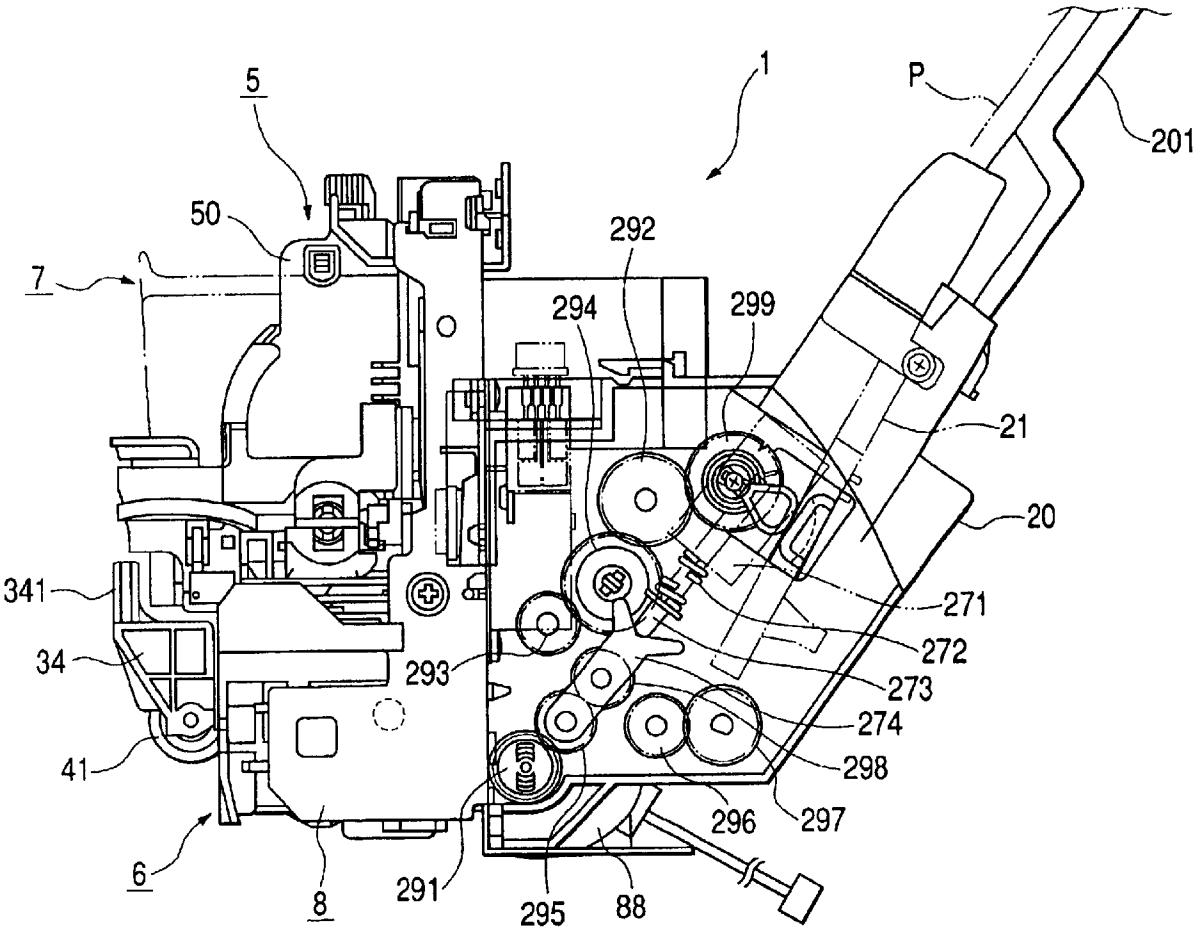
FIG. 2 is a side view of the above described recording apparatus.
Figure 3:
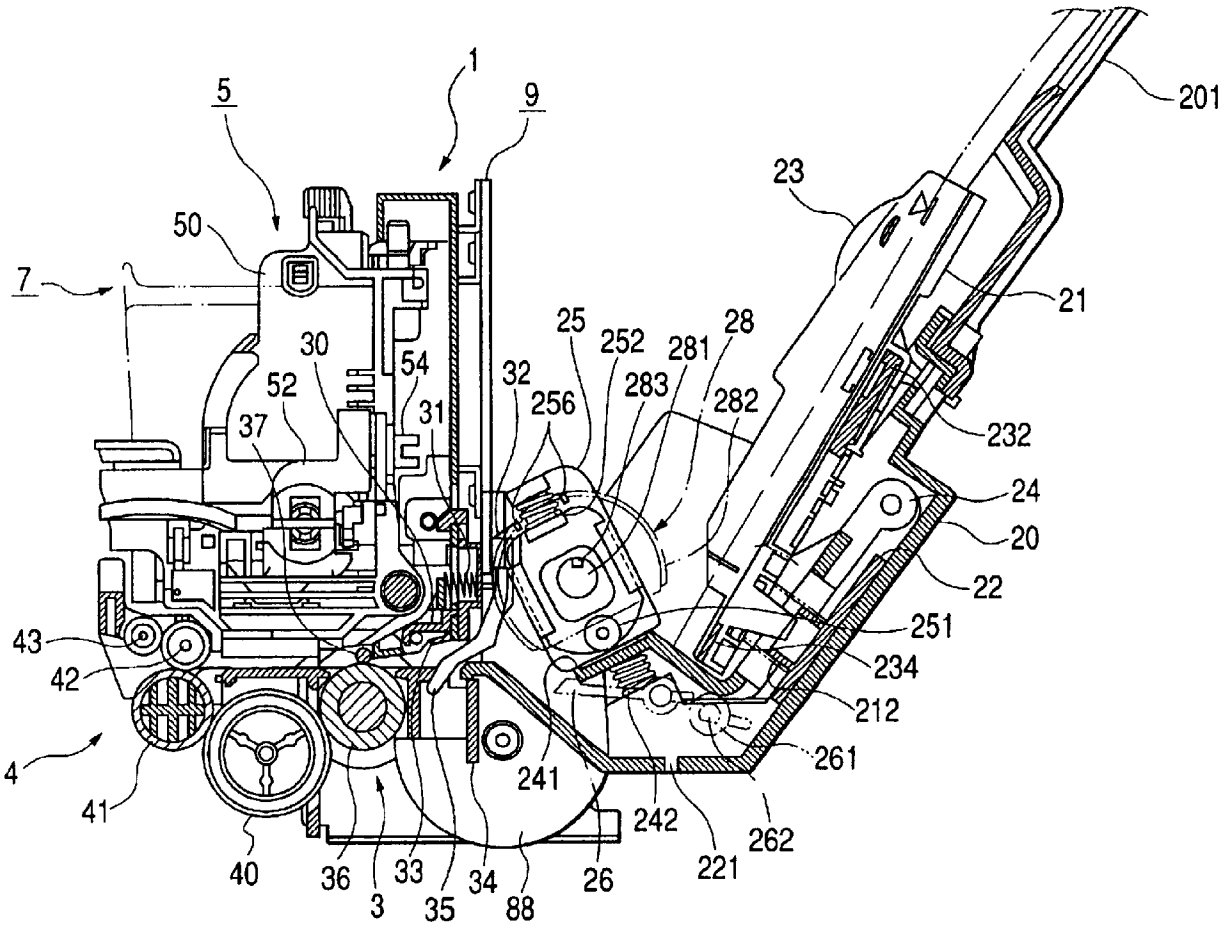
FIG. 3 is a side cross-sectional view of the above described recording apparatus.
Figure 4:
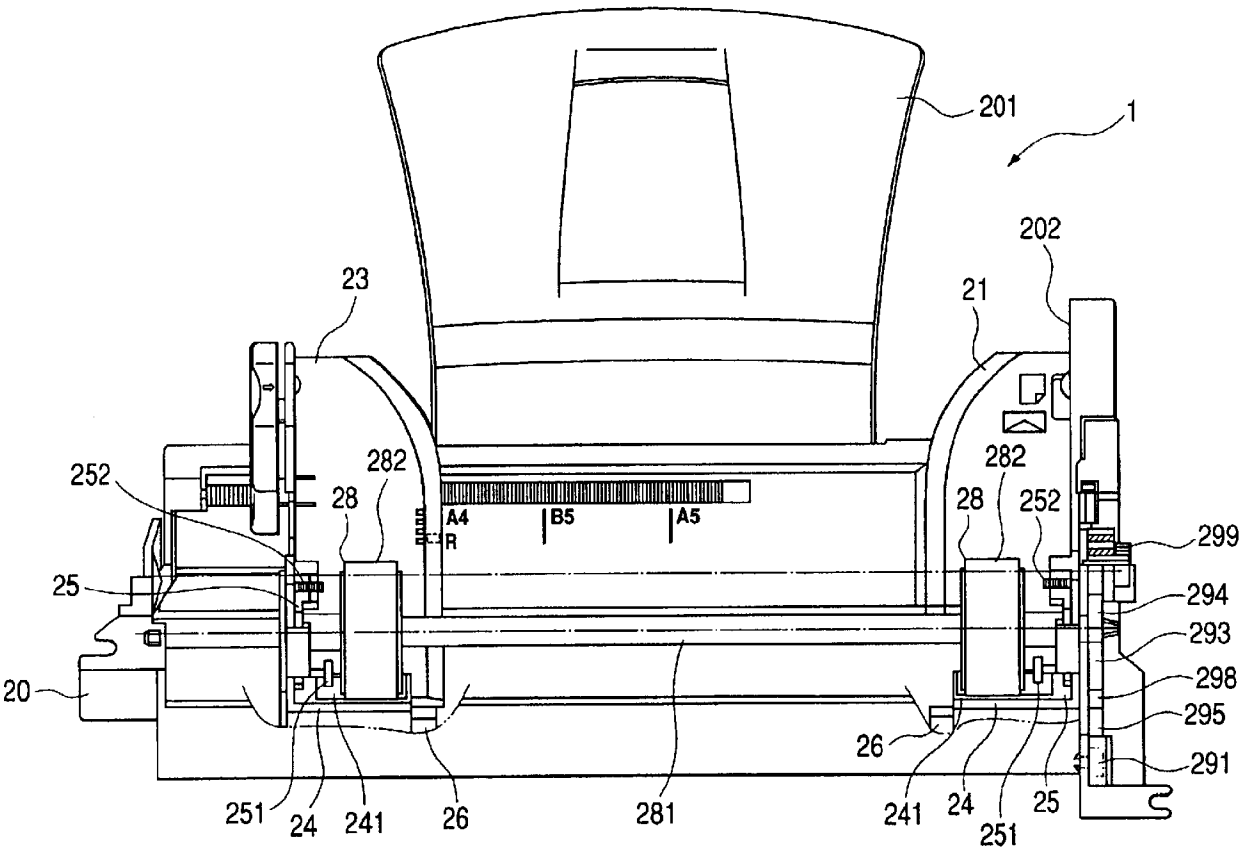
FIG. 4 is a front view explaining an arrangement of the sheet feeding device provided in the above described recording apparatus.

FIG. 1 is a front view of a recording apparatus which is one example of an image forming apparatus provided with a sheet feeding device according to a first embodiment of the present invention. FIG. 2 is its side view, FIG. 3 is its side cross-sectional view, FIG. 4 is a front view explaining the arrangement of the sheet feeding device provided in the recording apparatus.

In FIG. 1 to FIG. 4, reference numeral 1 denotes a recording apparatus, and this recording apparatus 1 is constituted by a sheet feeding device 2, a sheet feeding portion 3, a sheet discharging portion 4, an image forming portion 5, and a head cleaning portion 6.

Next, each of these portions will be described below.

First, the sheet feeding device 2 will be described below.

The sheet feeding device 2 comprises a sheet feeding tray 201 which is a sheet mounting means for mounting the sheets, a pressure plate 21 provided in the end portion at the sheet feeding direction side of this sheet feeding tray 201, a sheet feeding roller 28 which is a sheet feeding means for sending out sheets P mounted on the sheet feeding tray 201, and a base 20 in which the sheet feeding tray 201 is attached in an inclined state at angles of 40° to 60° to an apparatus main body.

Incidentally, the sheet feeding device 2 feeds the sheet by one side standard system taking the left side as a standard, which is constituted in such a manner that, even if a sheet size is different, a standard position of the sheet P remains the same. In the base 20, as shown in FIG. 4, a sheet end standard 202, which is a standard, is formed.

The sheet feeding roller 28 has a roughly circular shape when looked at from the side, and a peripheral circular arc portion of the sheet feeding roller 28 is attached to a sheet feeding roller rubber 282 which is composed of a high friction material such as EPDM rubber having a hardness of about 20° to 40° (A scale). Incidentally, an outside diameter of the sheet feeding roller 28 is 38 mm to 46 mm and has a D type shape in which a part of the circular arc portion is cut.

Incidentally, in the present embodiment, this sheet feeding roller 28 is provided at each of the right and left sides, and the sheet feeding roller 28 at the side of the sheet end standard is fixed to a sheet feeding roller axis 281, and the sheet feeding roller 28 at the opposite side can be slid in the direction of the sheet feeding roller axis 281 corresponding to a sheet size.

The sheet feeding roller axis 281 is, as shown in FIG. 3, provided with a groove 283 in an axial direction, and a fitting hole of the sheet feeding roller 28 to the axis 281 is provided with a convex portion (not shown) corresponding to the groove 283 and, by the groove 283 and the convex portion, a driving force from the sheet feeding roller axis 281 is transmitted to the sheet feeding roller 28.

On the other hand, the pressure plate 21 is rotatable with a rotation axis linked to the base 20 as a center and is energized to the sheet feeding roller 28 by two pressure plate springs 212 provided in the position nearly corresponding to the sheet feeding roller 28. Incidentally, the pressure plate 21 is movably provided with a movable side guide 23 so as to control a mounting position of the sheet P.

In the region on the pressure plate 21 and the movable side guide 23, opposed to the sheet feeding roller 28 of the movable side guide 23, there is provided a separating sheet 234 which is a first separating member composed of a material having a large frictional coefficient such as an artificial leather and the like for preventing a double feed of the sheets P. This separating sheet 234 has the same performance as a separating pad 241 which is a second separating member formed by a high friction member to be described hereinafter.

By the way, a separating base 22 is attached to the base 20, and on this separating base 22 is rotatably maintained with the rotation axis linked to the separating base 22 as a center, a separating pad holder 24 which has the separating pad 241 constituting a separating means for separating the sheets P one by one. This separating pad holder 24 is energized to the sheet feeding roller 28 by a separating pad spring 242.

This separating pad 241 is constituted by a material (for example, material such as cork and the like) of which the frictional coefficient to the sheet P is smaller than that of the sheet feeding roller rubber 282. Also, each of the pad and the rubber is constituted by the material of which the frictional coefficient is larger than that between the sheets.

That is, if the frictional coefficient between the sheet feeding roller rubber 282 and the sheet P is denoted by $\mu 1$, the frictional coefficient between the separating pad 241 and the sheet P by $\mu 2$ and the frictional coefficient between the sheets P by $\mu 3$, a formula is given as $\mu 1 > \mu 2 > \mu 3$.

Incidentally, the separating pad holder 24 is provided with a roller holder 25, and there is rotatably attached to the roller holder 25 a roller 251 which is constituted in such a manner as to be energized to the separating pad 241 by a roller spring 252 at a predetermined pressure.

The spring pressure of the roller spring 252 can control, a friction force f4 between the sheet P and the separating pad 241 due to the energizing force of the roller 251 so as to provide such a back tension that has little influence on conveyance accuracy, and it is set at about 0.5N to 1N so as to be capable of preventing the falling of the sheets P. In addition, rather than the abutting force between the separating pad 241 and the sheet feeding roller 28, the energizing force between the roller 251 and the separating pad 241 is set smaller.

Incidentally, when looked at from the side, the abutting position between the roller 251 and the separating pad 241 is nearly the same as the abutting position between the sheet feeding roller rubber 282 and the separating pad 241, and the roller holder 25 is controlled in its movement by a control rib provided in the separating base 22 so that the roller 251 is not separated by more than a predetermined distance in a separating direction from the separating pad 241.

By providing the control rib in this way, even when the roller 251 is lifted above the separating pad 241 due to rigidity of a thick paper and the like, it can be controlled at a predetermined position. Thus, the roller 251 enters the inside of the sheet feeding roller rubber 282 so that the sheet P abuts against the sheet feeding roller rubber 282 and no more large back tension would occur.

Incidentally, in the inside of each of the right and left sheet feeding rollers 28 is provided a rotatable return lever 26 for returning the sheet P which enters the separating pad 241 to the mounting position on the pressure plate 21, with the rotation axis linked to the separating base 22 as a center. This return lever 26 is rotated by a return lever cam 261 in which a drive is transmitted by a lever cam axis 262.

As described above, though the sheet feeding rollers 28 are symmetrically constituted right and left, the sheet feeding roller 28 at the side of the non-sheet end standard is connected to the movable side guide 23 which is attached to the pressure plate 21. For this reason, when the movable side guide 23 is moved by matching a sheet size, the sheet feeding roller 28 also follows the movement and moves to a predetermined position. In this way, sheet feeding performance as well as the right and left balance of the back tension can be improved so as to reduce bias movement and the like.

By the way, in FIG. 2, reference numeral 299 denotes a release cam gear for releasing abutment between the pressure plate 21 and the sheet feeding roller 28. When the pressure plate 21 descends to a predetermined position shown in the drawing by the rotation of the release cam gear 299, a notch portion of the sheet feeding roller 28 is set in such a manner as to come to a position opposite to the separating pad 241.

In this way, the separating pad 241 can be separated from the sheet feeding roller 28. Incidentally, the present embodiment is constituted in such a manner that, before the pressure plate 21 and the sheet feeding roller 28 abut against each other, the sheet feeding roller 28 and the separating pad 241 abut against each other, and after the pressure plate 21 and the sheet feeding roller 28 are separated, the sheet feeding roller 28 and the separating pad 241 are separated.

Next, the sheet feeding portion 3 will be described below.

The sheet feeding portion 3 is attached to a chassis 8 formed of a sheet metal which is bent and raised up, and has a PE sensor 32 and a conveying roller 36 which is a conveying means for conveying the sheet P. The conveying roller 36 is constituted in such a manner that an elastic member such as rubber winds around the surface of a metallic axis, and the metallic portions of both ends are borne by an electrically conductive bearing 38 and attached to the chassis 8. Incidentally, in order to perform a steady conveyance by giving a load of the rotational time, a conveying roller tension spring 381 is provided between the bearing 38 and the conveying roller 36 so as to provide a predetermined load by energizing the conveying roller 36.

On the other hand, the conveying roller 36 is abutted by a plurality of pinch rollers 37 which are driven members. Incidentally, this pinch roller 37 is maintained by a pinch roller guide 30, and is pressed against the conveying roller 36 by being energized by a pinch roller spring 31, thereby generating a conveying force of the sheet P.

Moreover, the entrance of the sheet feeding portion 3, to which the sheet P is conveyed, is provided with an upper guide 33 and a platen 34 for guiding the sheet P. In addition, the upper guide 33 is provided with a PE sensor lever 35 which transmits a top end and a rear end detection of the sheet P to the PE sensor 32.

In the above described arrangement, the sheet P which was sent to the sheet feeding portion 3 is guided by the platen 34, the pinch roller guide 30 and the upper guide 33, and is sent to a pair of rollers comprising the conveying roller 36 and the pinch roller 37. On this occasion, the top end of the sheet P sent is detected by the PE sensor lever 35 so that a recording position of the sheet P is obtained. Also, the sheet P is conveyed on the platen 34 by the rotation of the conveying roller 36 by an LF motor 88.

Next, the image forming portion 5 will be described below.

The image forming portion 5 is provided at the downstream side in a sheet conveying direction of the conveying roller 36, and has a carriage 50 for mounting a recording head 7. This recording head 7 adopts an ink jet recording head, which is integrally formed with an ink tank and easy to replace. Incidentally, this recording head 7 can give heat to ink by heater and the like and, by this heat, the ink is film-boiled, and by pressure change generated by the growth and the contraction of bubbles due to this film boiling, the ink is ejected from the nozzle of the recording head 7 so as to form an image on the sheet P.

On the other hand, the carriage 50 is maintained by a guide axis 81 and a guide rail 82. The guide axis 81 serves to reciprocatively scan in a direction crossing a conveying direction of the sheet P, and the guide rail 82 serves to hold a rear end of the carriage 50 and thus maintain the gap between the recording head 7 and the sheet P. Incidentally, the guide axis 81 is attached to the chassis 8, while the guide rail 82 is integrally formed with the chassis 8.

By integrally forming the guide rail 82 with the chassis 8 in this way, the number of parts is reduced, the number of steps required for attachment work is reduced, and an increase in cost is controlled. Also, due to bending of the guide rail 82, rigidity of the chassis 8 is enhanced so that reliability in strength is improved. Moreover, if the conventional strength is enough, a board thickness of the sheet metal, which forms the chassis 8, can be made smaller, and this will invite much lower cost.

The carriage 50 is driven by a carriage motor 80 attached to the chassis 8 through a timing belt 83. This timing belt 83 is stretched and supported by an idle pulley 84. Moreover, the carriage 50 is provided with a flexible substrate 56 for transmitting a signal from an electrical substrate to the recording head 7.

Next, the sheet discharging portion 4 will be described below.

The sheet discharging portion 4 comprises a transmitting roller 40 which abuts against the conveying roller 36 and a sheet discharging roller 41 which abuts against the transmitting roller 40. The driving force of the conveying roller 36 is transmitted to the sheet discharging roller 41 through the transmitting roller 40. A spur 42 is so abutted against the sheet discharging roller 41 as to allow its rotation coupled-driven by the sheet discharging roller 41.

This spur 42 is attached to an integral spur station 341 which is provided in the platen 34 and, by providing the spur station 341 integrally with the platen 34 in this way, the dimensions of the spur 42 and the sheet discharging roller 41 can be managed within the same component so that dimensional relations can be stably maintained.

Next, the head cleaning portion will be described below.

The head cleaning portion 6 is constituted by a pump (not shown) for performing cleaning of the recording head 7, a cap (not shown) for controlling the drying of the recording head 7, and a drive switching arm 62 for switching the driving force from the conveying roller 36 to the sheet feeding device 2 and the pump. Incidentally, since the drive switching arm 62 fixes a planetary gear 63, which rotates around an axis center of the conveying roller 36 as a center, to a predetermined position except for the sheet feeding and head cleaning time, the driving force is not transmitted to the sheet feeding device 2 and the pump.

On the other hand, when the drive switching arm 62 is switched by movement of the carriage 50, the planetary gear 63 becomes free and, corresponding to the normal revolution and the reverse revolution of the conveying roller 36, the planetary gear 63 moves. When the conveying roller 36 is rotated normally, the driving force is transmitted to the sheet feeding device 2 and, when it is rotated in reverse, the driving force is transmitted to the pump. However, when the driving force is transmitted to the sheet feeding device 2, the planetary gear 63 is maintained in the position where it acts on an input gear 291, and it is therefore possible to transmit normal and reverse revolutions.

Next, an image recording operation of the recording apparatus 1 which is constituted in this way will be described below.

When the image recording operation starts, first of all, the driving force carried by the conveying roller 36 is transmitted to the sheet feeding roller 28 and the release cam 299 by the gear and the like, whereby the release cam 299 is separated from the pressure plate 21, and the pressure plate 21 which is pushed down to a predetermined position by the release cam gear 299 is lifted. When the pressure plate 21 is lifted in this way, the sheet feeding roller 28 abuts against the sheets P, and accompanied with the rotation of the sheet feeding roller 28, the sheets P are picked up and, after that, are separated one by one by the separating pad 241 and sent to the sheet feeding portion 3.

Incidentally, when the sheets P are sent to the sheet feeding portion 3 in this way, the sheet feeding roller 28, the pressure plate 21 and the separating pad 241 are released by the release cam gear 299. Moreover, when the recording of the sheet P is completed and the sheet discharging operation is completed, the return lever 26 acts on the sheet P which has entered on the separating pad 26, and brings it back to the mounting position on the pressure plate 21.

Next, the sheet P which has been sent to the sheet feeding portion 3 is guided by the platen 34, the pinch roller guide 30 and the upper guide 33, and is sent to a pair of rollers comprising the conveying roller 36 and the pinch roller 37, and further is conveyed to an image forming row position (position in a conveying direction of the sheet P) of the image forming portion 5 by the conveying roller 36 and the pinch roller 37.

Next, by the carriage motor 80, the carriage 50 is moved to an image forming column position (position to cross a conveying direction of the sheet P), and the recording head 7 is opposed to the image forming position. Then, based on the signal from the electrical substrate, the recording head 7 ejects ink toward the sheet P so as to form an image. Incidentally, after that, the sheet P in which an image has been formed in the image forming portion 5 is held by nips of the sheet discharging roller 41 and the spur 42 and conveyed and discharged to a discharging tray (not shown) and the like.

By the way, in the present embodiment, the drive of the normal revolution of the conveying roller 36 is transmitted to the sheet feeding roller 28. Next, the drive transmitting operation will be described below by using FIG. 5A to FIG. 5C.

Figure 5A:
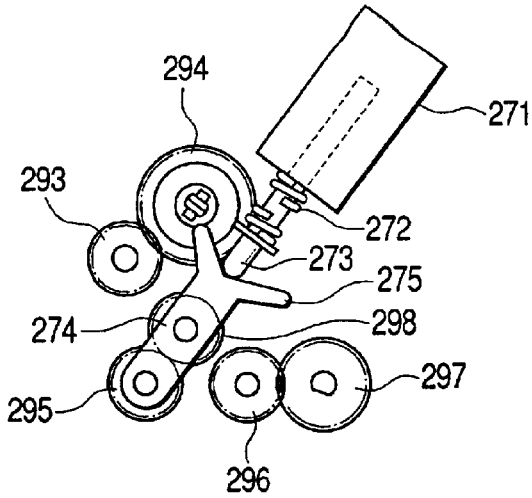
FIG. 5A, FIG. 5B and FIG. 5C are views explaining a part of the drive transmitting operation of the above described sheet feeding device.

When the conveying roller 36 is rotated normally or in reverse, this drive is transmitted to a planetary gear 298. Usually, as shown in FIG. 5A, a solenoid pin 273, which controls the position of the planetary gear 298, acts on the control groove of a planetary gear arm 274, to which the planetary gear 298 is attached, so that since the position of the planetary gear 298 is controlled, even when the conveying roller 36 is rotated normally or in reverse, the drive is not transmitted to other portions.

Figure 5B:
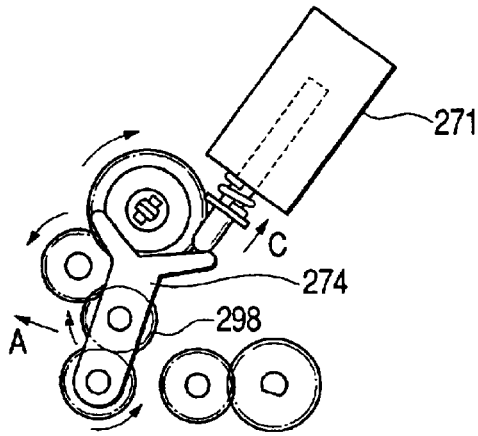

Next, as shown in FIG. 5B, when the solenoid pin 273 is released in the direction of an arrow mark C by operating a solenoid 271, the planetary gear 298 is released from a position control. When, in this state, the conveying roller 36 is rotated normally, the planetary gear arm 274 moves in the direction of an arrow mark A by a drive switching gear 295, and accompanied with this, the planetary gear 298 acts on the release cam gear 299 so as to rotate the release cam gear 299. Thereby, the release cam gear 299 performs the release of the pressure plate 21 or cancellation of the release and can separate the pressure plate 21 from the sheet feeding roller 28 so as to energize the plate.

Moreover, the drive is transmitted from the release cam gear 299 to the sheet feeding roller gear 294 through an idler gear 293 so as to rotate the sheet feeding roller 28. As described above, the sheet feeding roller 28 has the notch portion, and is constituted so as to match the release gear in its phase.

Figure 5C:
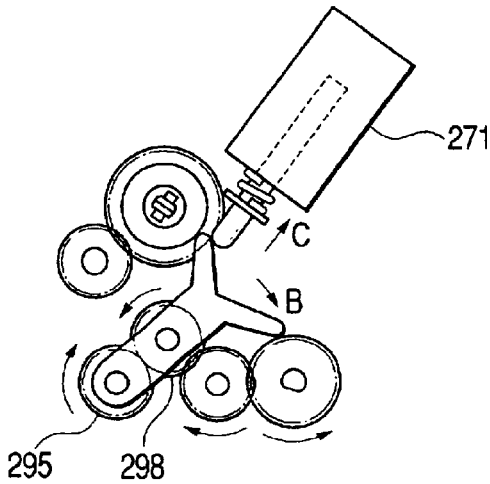

As shown in FIG. 5C, when the conveying roller 36 is rotated in reverse, the planetary gear 298 moves in the direction of the arrow mark B and acts on a return lever drive input gear 297. The transmitted drive is transmitted to the return lever cam axis 262 and the return lever cam 261 shown in FIG. 3 through a return lever cam gear 296, and rotates the return lever 26.

Incidentally, when the operation of the solenoid 271 is released, since the solenoid pin 273 enters and acts on a cam portion 275 formed toward the control groove of the planetary gear arm 274 by the energizing force of a solenoid spring 272, the solenoid pin 273 can maintain the planetary gear 298 in a predetermined control position.

Next, the sheet feeding operation of the sheet feeding device 2 will be described below.

Figure 6A:
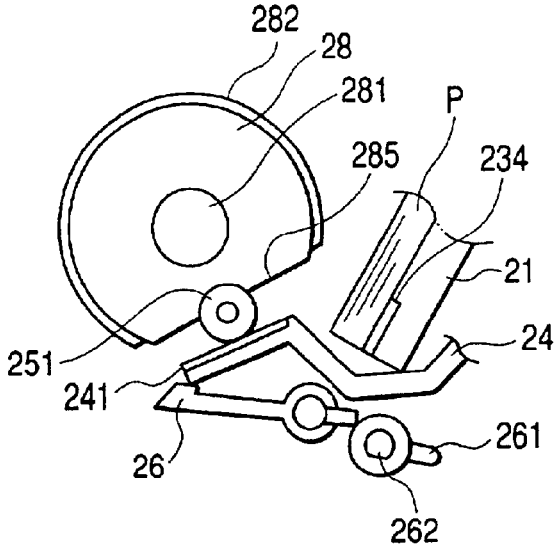
FIG. 6A, FIG. 6B and FIG. 6C are views explaining a part of the sheet feeding operation of the above described sheet feeding device.

FIG. 6A shows an initial state and, when in this initial state, a release cam 299 is in a state of pushing down the pressure plate 21 to a predetermined position, whereby the pressure plate 21 and the sheet feeding roller 28 are separated.

Incidentally, on this occasion, since the notch portion of the sheet feeding roller 28 is in a position opposite to the separating pad 241, the separating pad 241 is also in a state of being separated from the sheet feeding roller 28. Also on this occasion, the roller 251 is energized to the separating pad 241 at a predetermined pressure, and the return lever 26 completes the return operation and is positioned in an evacuated state from the conveying route of the sheet P.

Next, when the sheet feeding operation starts, in this state, the drive force carried by the conveying roller 36 is transmitted to rotate the sheet feeding roller 28 normally by a gear array and the like. On this occasion, as shown in FIG. 5B, when the solenoid pin 273 is released by operating the solenoid 27', the planetary gear arm 274 is released from the position control. In this way, when the conveying roller 36 is rotated normally, the planetary gear 298 abuts against the gear portion of the release cam gear 299 and transmits the drive.

Figure 6B:
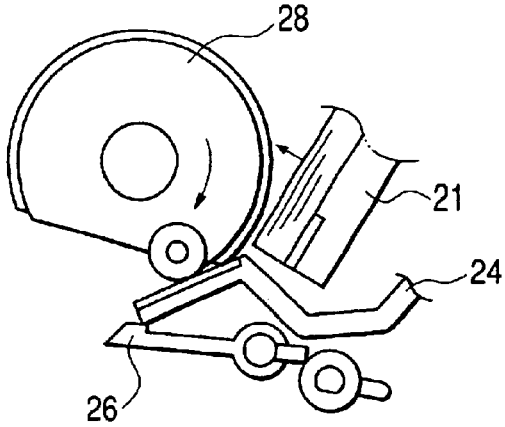

As a result, as shown in FIG. 6B, the sheet feeding roller 28 starts rotating and, immediately after the circular arc portion of the sheet feeding roller 28 abuts against the separating pad 241, the release cam gear 299 is separated from the pressure plate 21 so that the pressure plate 21 starts lifting. On this occasion, even when the mounted sheet P becomes unsteady due to movement of the pressure plate 21, since the separating pad 241 and the sheet feeding roller 28 are already in a state of abutting against each other, the sheet P is prevented from entering prior to the separating pad 241.

Figure 6C:
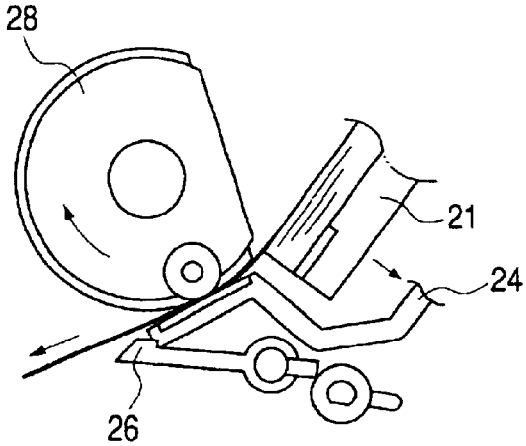

When the pressure plate 21 is lifted, the sheet P abuts against the sheet feeding roller 28, and accompanied with the subsequent revolutions of the sheet feeding roller 28, the sheet P is picked up and the sheet feeding is started (see FIG. 6C). Since the relationship of the frictions among the sheet feeding roller 28, the separating pad 241 and the sheet P is as described above, only the sheet P in the top most position is fed, and the next sheet P et seq. are not fed.

Next, after the sheets P thus separated one by one are sent to the sheet feeding portion 3, the PE sensor 31 detects the top end, and then the sheet is sent by a predetermined distance thereof is sent and held between the sheet conveying roller 36 and the pinch roller 37. Incidentally, when the sheet feeding roller 28 is rotated by one revolution, the release cam gear 299 releases the pressure plate 21 so that the sheet feeding roller 28 and the pressure plate 21 are separated.

Figure 7A:
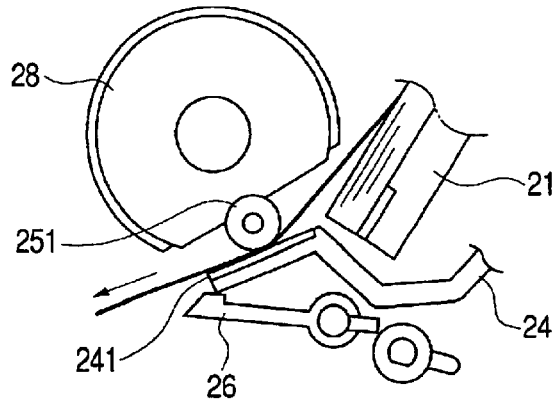
FIG. 7A, FIG. 7B and FIG. 7C are views explaining other part of the sheet feeding operation of the above described sheet feeding device.
Figure 7B:
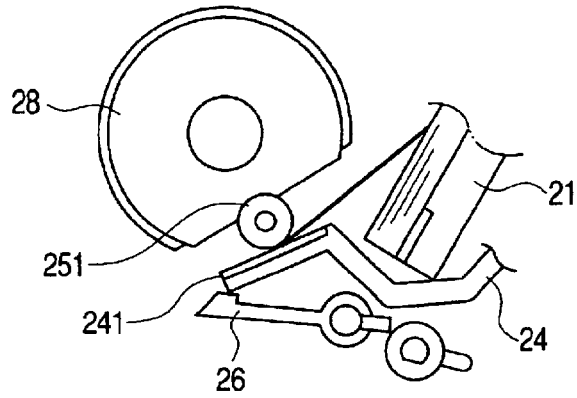

Next, as shown in FIG. 7A and FIG. 7B, since the circular arc portion of the sheet feeding roller 28 and the separating pad 241 are separated after the pressure plate 21 and the sheet feeding roller 28 are separated, the sheet P becomes unsteady due to movement of the pressure plate 21. However, on this occasion, since the separating pad 241 and the sheet feeding roller 28 are in a state of abutting against each other, the sheet P is prevented from entering prior to the separating pad.

In this state, the action of the solenoid 271 is released again and, as shown in FIG. 5A, the planetary gear 298 is maintained in a predetermined position. In this state, the driving force from the conveying roller 36 is disenabled.

Incidentally, when the sheet P and the separating pad 241 are in the state as shown in FIG. 7A and FIG. 7B, since the friction force f4 generated between the sheet P as conveyed and recorded and the separating pad 24, by the energizing force of the roller 251, is controlled to a back tension to a degree that has little effect on the conveying accuracy and, moreover, set in such a manner as to allow to prevent the falling of the sheet P, the good conveying accuracy, which has no influence of a back tension, can be acquired and at the same time the entering of the sheet P is prevented.

Moreover, since the abutting position of the roller 251 and the separating pad 241 is nearly the same as the abutting position of the sheet feeding roller 28 and the separating pad 241 when looked at from the side, the prevention of the sheet P from entering at the separating pad 241 can be compatible with the prevention of the double feed indicating that the next sheet P also is fed at the time of separating and feeding.

On the other hand, after the rear end of the recorded sheet P conveyed by the conveying roller 36 passes through the PE sensor 36 and the sheet discharging is completed, the solenoid 271 is operated as shown in FIG. 5C, whereby the position control of the planetary gear 298 is released and a reversal revolution drive is transmitted to the sheet feeding roller 28. When the sheet feeding roller 28 is rotated in reverse in this way, the drive is transmitted to the return lever action cam 261 so as to operate the return lever 26.

Figure 7C:
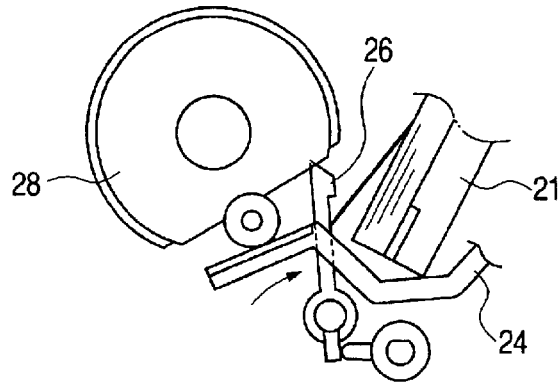

In this way, as shown in FIG. 7C, the sheet P remaining on the separating pad 241 is returned to the mounting position. After that, when the return claw action cam 261 further rotates and does not act on the return lever 26, the return lever 26 is constituted so as to return to the initial position of FIG. 6A by its own weight. Thereby, the prevention of function of the sheet P from entering to the separating pad 241 and the following can be further improved.

With the process as described above, a series of the sheet feeding operations is completed. When the next sheet P is fed, the above described operations are repeated again.

By the way, in the case that the sheet P to be fed has a large amount of paper dust and the like, as the number of recording papers advances, the sheet feeding force of the sheet feeding roller rubber 282 is reduced. In this state, when a thick paper and the like having a high conveying resistance is fed, a sheet feeding failure sometimes occurs.

Hence, in the present embodiment, in such a case, a cleaning mode is set up in which the sheet feeding roller 28 is frictionally slid with the separating pad 241 and the separating sheet 234, and is rotated for the predetermined number of revolutions in the rotational direction of the sheet feeding time, and, in therefore, the paper dust adhered to the sheet feeding roller rubber 282 and the like is removed so that the sheet feeding force of the sheet feeding roller rubber 282 can be restored.

Next, the cleaning mode of such a sheet feeding roller 28 will be described below.

For example, when a sheet feeding failure occurs, first of all, a user takes off the mounted sheet P from the mounting position. Then, he/she performs a predetermined operation, for example, continuous by pushing of a resume key 101 shown in FIG. 8 and, after three flashes of LED, detached his/her hand from the key. Then, a control device 100 shown in the drawing enters the cleaning mode.

Figure 8:
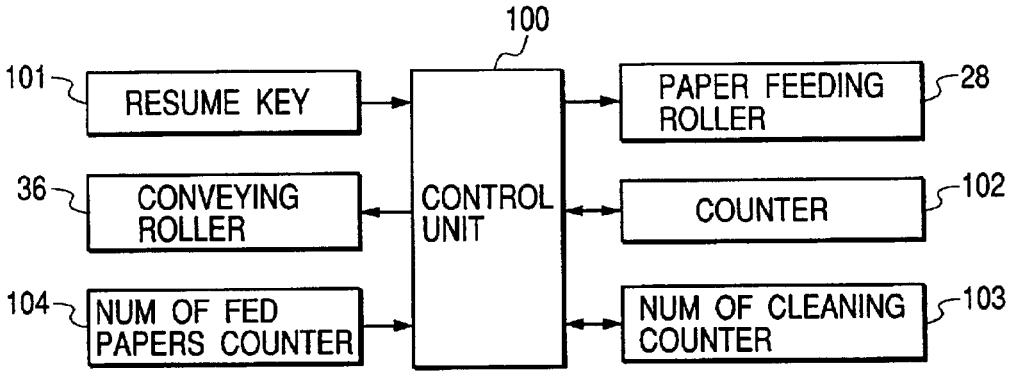
FIG. 8 is a block diagram of the above described sheet feeding device.
Figure 9:
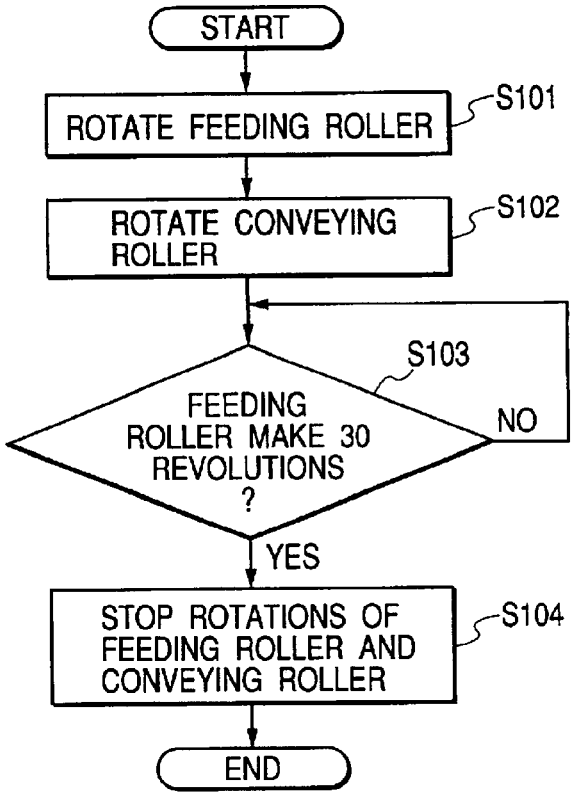
FIG. 9 is a flow chart explaining a cleaning mode of the above described sheet feeding device.

When the cleaning mode is entered in this way, a flow chart shown in FIG. 9 starts. First of all, the control device 100 rotates normally the sheet feeding roller 28 and the conveying roller 36 (S101, S102). Next, the number of revolutions of the sheet feeding roller 28 is counted by a counter 102 (see FIG. 8), and the sheet feeding roller 28 is rotated for 30 revolutions in the rotational direction of the sheet feeding time.

Figure 10:
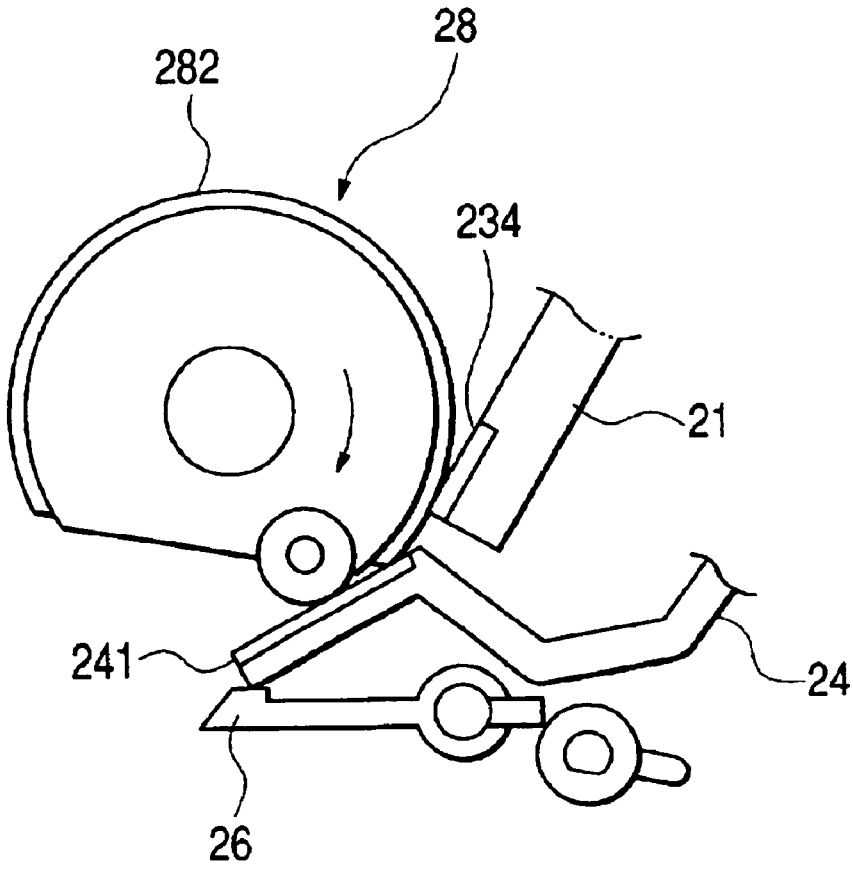
FIG. 10 is a view showing a status of the sheet feeding device in the above described cleaning mode.

On this occasion, as shown in FIG. 10, the sheet feeding roller rubber 282 slides over the separating pad 241. Since the sheet P is removed, the sheet feeding roller rubber 282 also slides against the separating sheet 234. On this occasion, the paper dust and the like adhered to the sheet feeding roller rubber 282 are removed.

Next, after the sheet feeding roller 28 is continuously rotated for 30 revolutions in this way (Y of S103), the sheet feeding roller 28 and the conveying roller 36 are stopped (S104).

In the present embodiment, the separating pad 241 is constituted by, for example, urethane foam in such a manner as to have a large number of hollows on the surface. Also, hardness of the surface of the sheet feeding roller rubber 282 is set to 75° or more to 95° or less so that the surface can be subjected to cleaning. The separating sheet 234 may adopt the same arrangement as that of the separating pad 241.

In this way, the dust on the separating pad 241 from among the removed paper dust enters the foam portion of the separating pad 241. Incidentally, since the separating sheet 234 is in a steep inclined state, the dust on the separating sheet 234 falls into a predetermined place inside the sheet feeding device. Consequently, the separating sheet 234 and the separating pad 241 themselves do not cause such problem as reduction in frictional coefficident due to adherence of paper dust.

On the occasion of the cleaning mode, during the rotation of the sheet feeding roller 28, the conveying roller 36 also rotates, so that the conveying roller 36 rotates while pressing against the pinch roller 37. On this occasion, since the paper dust adhered to the conveying roller 36 can also be removed, conveying accuracy and engaging performance of a pair of rollers with the nip can be enhanced.

In this way, even when the coat dust of the coat paper, various paper dust and the like adhere to the sheet feeding roller rubber 282, thereby reducing the conveying force, the sheet feeding failure can be prevented in advance, because in the cleaning mode, the sheet feeding roller 28 is abutted against at least either one of the separating sheet 234 and the separating pad 241 and is rotated for the predetermined number of revolutions, whereby the surface of the sheet feeding roller 28 is subjected to cleaning.

Since the surface of the sheet feeding roller 28 can be subjected to cleaning without using special/other part such as a cleaning sheet and the like, no special/other part is required, and neither does there arise any inconvenience of handling such as management of special parts, nor any increase in cost due to further addition of the parts.

By the way, in the description made so far, the sheet feeding roller 28 is allowed to rotate continuously for 30 revolutions. However, in the case where it is feared that the sheet feeding roller rubber 282, the separating pad 241 and the separating sheet 234 are deteriorated due to heat generated by mutual sliding movements because of continuous revolution, the sheet feeding roller 28 may be allowed to rotate intermittently.

On the occasion of the normal recording mode, when a recording command is issued without any sheet on the sheet feeding device 2, the sheet feeding roller 28 is rotated by one or two revolutions without having any sheet. However, when a sheet cannot be detected by the PE sensor 32, an error is notified and the sheet feeding roller 28 is not rotated any more. That is, the operation thereof is different from the above described cleaning mode.

Second Embodiment

Next, a second embodiment of such a present invention will be described below.

Figure 11:
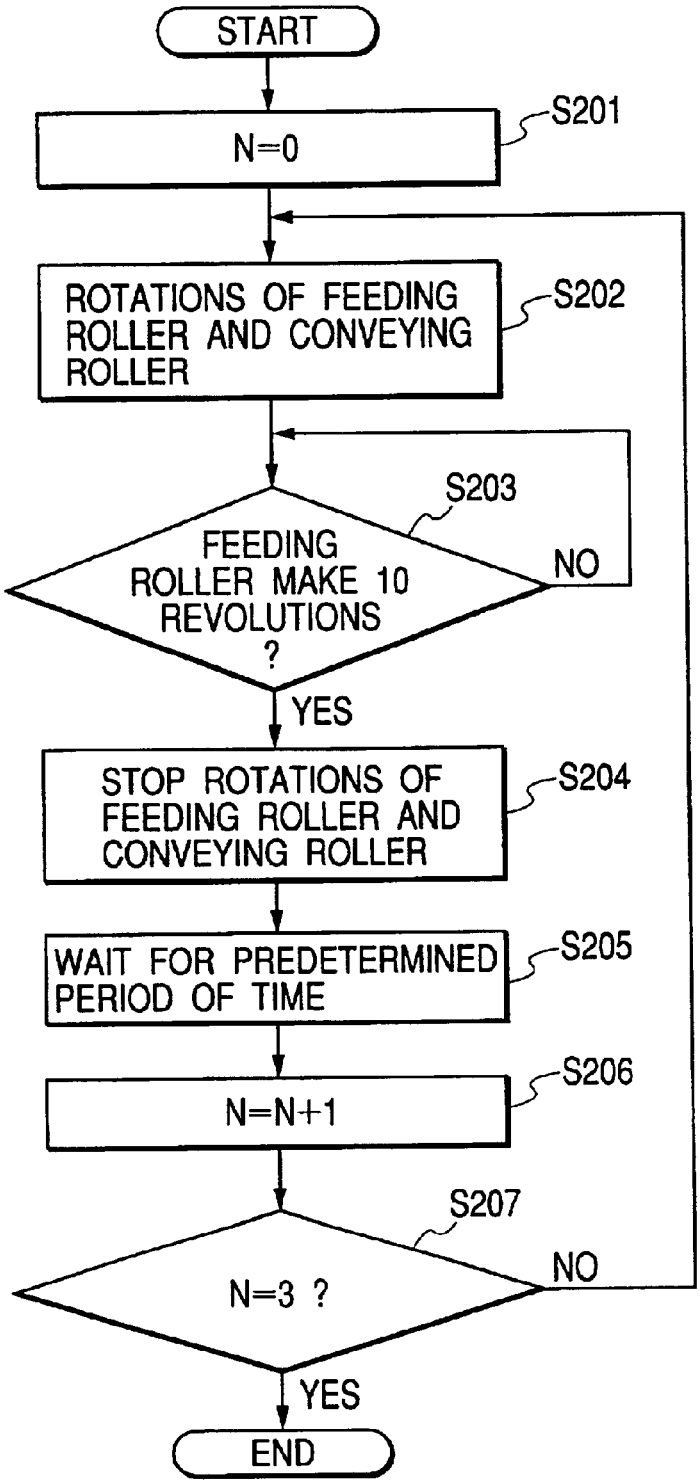
FIG. 11 is a flow chart explaining the cleaning mode of the sheet feeding device according to a second embodiment of the present invention.

FIG. 11 is a flow chart explaining a cleaning mode of the sheet feeding device according to the present embodiment. In the present embodiment, as shown in the flow chart, first of all, when a resume key 101 is operated, the control device 100 sets a count value N of a cleaning number of times counter 103 (see FIG. 8) to 0 (S201) and rotates normally the sheet feeding roller 28 and the conveying roller 36 (S202). Next, the number of revolutions of the sheet feeding roller 28 is counted by the counter 102, and the sheet feeding roller 28 is rotated continuously for ten revolutions in the direction of the sheet feeding time.

On this occasion, as shown in FIG. 10 as already described, the sheet feeding roller rubber 282 slidably moves over and with the separating pad 241 and the separating sheet 234. On this occasion, the paper dust and the like adhered to the sheet feeding roller rubber 282 is removed.

Next, after the sheet feeding roller 28 is rotated continuously for ten revolutions (Y of S203), the sheet feeding roller 28 and the conveying roller 36 are stopped (S204). Then, after waiting for a predetermined time, for example, 10 to 20 seconds (S205), the count value N of the cleaning number of times counter 103 is increased by 1 (S206), and the process of S202 to S205 is repeated until the count value N becomes 3 (S207).

When the count value N becomes 3 (Y of S207), that is, after ten continuous revolutions are repeated three times, the cleaning mode is completed.

Thus, it is possible to prevent the deterioration of the sheet feeding roller rubber 282, the separating pad 241 and the separating sheet 234 due to heat and the like generated from mutual sliding movements because of continuous revolutions. Furthermore, by doing so, a material which is weak to heat can be handled and therefore it is possible to enhance the degree of freedom of the material.

In the description made so far, the arrangement has been described in which an operator performs the cleaning mode by operating a key, but the present invention is not limited to this, and the arrangement may be so arranged that the cleaning mode is automatically entered when the feeding of a predetermined number of sheets is completed.

Third Embodiment

Figure 12A:
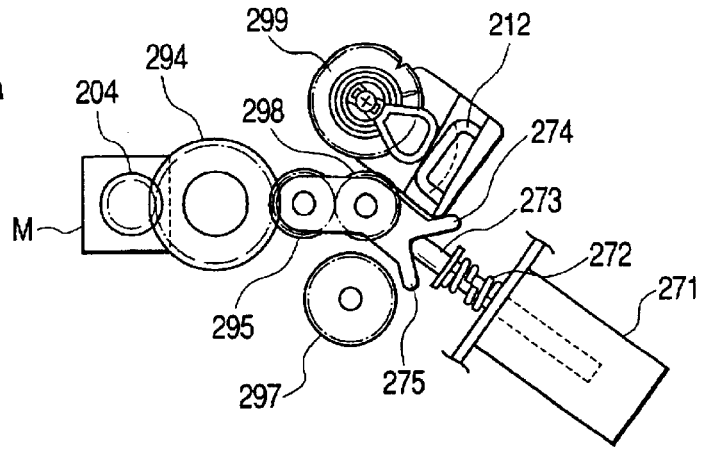
FIG. 12A, FIG. 12B and FIG. 12C are views explaining the drive transmitting action of the sheet feeding device according to a third embodiment of the present invention.
Figure 12B:
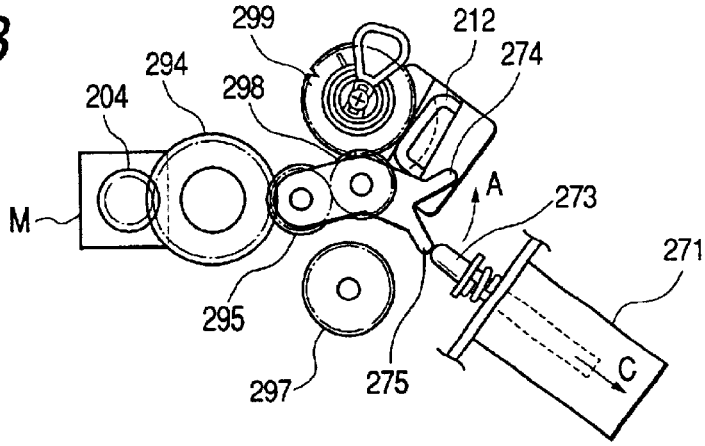
Figure 12C:
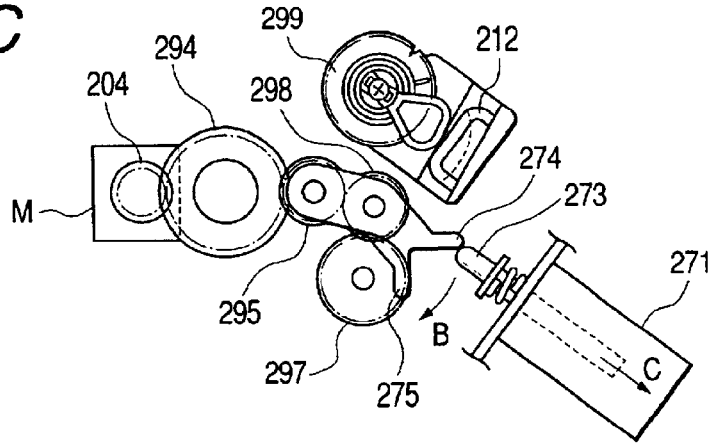

FIG. 12A to FIG. 12C are views explaining the drive transmitting operation of a sheet feeding device according to a third embodiment of the present invention. Incidentally, in the same drawing, the same reference numerals as those of FIG. 5A to FIG. 5C show the same or equivalent components.

In the same drawings, reference character M denotes an exclusive motor for driving a sheet feeding motor gear 204, and the drive of this exclusive motor M is transmitted from the sheet feeding motor gear 204 to a sheet feeding roller gear 294 which is directly connected to the sheet feeding roller 28. Incidentally, since the drive is directly transmitted to the sheet feeding roller gear 294, the sheet feeding roller 28 can be rotated normally or in reverse.

The drive transmission subsequent to the sheet feeding roller gear 294 is constituted in such a manner that the connection or disconnection thereof can be selected. That is, the drive transmitted to the sheet feeding roller 28 is transmitted to the planetary gear 298 as shown in FIG. 12A. The solenoid pin 273 which usually performs the position control of the planetary gear 298 acts on the control groove of the planetary gear arm 274 so that the position of the planetary gear 298 is controlled and therefore the drive is not transmitted to other portions even if the sheet feeding roller 28 is rotated normally or in reverse.

Next, as shown in FIG. 12B, when the solenoid pin 273 is released in the direction of the arrow mark C by operating the solenoid 271, the planetary gear 298 is released from the position control. In this way, when the sheet feeding roller 28 is rotated normally, the planetary gear arm 274 moves in the direction of the arrow mark A, and the planetary gear 298 acts on the release cam gear 299 so as to rotate the release cam gear 299. Thereby, the release cam gear 299 performs the release of the pressure plate 21 or cancellation of the release and separates the pressure plate 21 from the sheet feeding roller 28 so as to energize the plate.

As shown in FIG. 12C, when the sheet feeding roller 28 is rotated in reverse, the planetary gear 298 moves in the direction of the arrow mark B and acts on the return lever drive input gear 297. The transmitted drive is transmitted to the return lever cam gear 296, the return lever cam axis 262 and the return lever cam 261 so as to rotate the return lever 26.

Incidentally, when the action of the solenoid 271 is released, the solenoid pin 273 acts on the cam portion 275 which is formed toward the control groove of the planetary gear arm 274 provided with the planetary gear 298 by the energizing force of the solenoid spring 272 and enters there, and it is therefore possible to maintain the planetary gear at a predetermined control position.

In the present embodiment, when a cleaning mode is entered, the solenoid 271 is not allowed to operate, and therefore, even when the sheet feeding roller 28 is rotated, the pressure plate 21 and the return lever 26 are not allowed to rotate. Consequently, even when the sheet feeding roller 28 is rotated in a state of being mounted with the sheet P, the sheet feeding roller 28 does not act on the sheet P, and therefore it is possible to perform the cleaning mode even in a state of being mounted with the sheet P.

Figure 13:
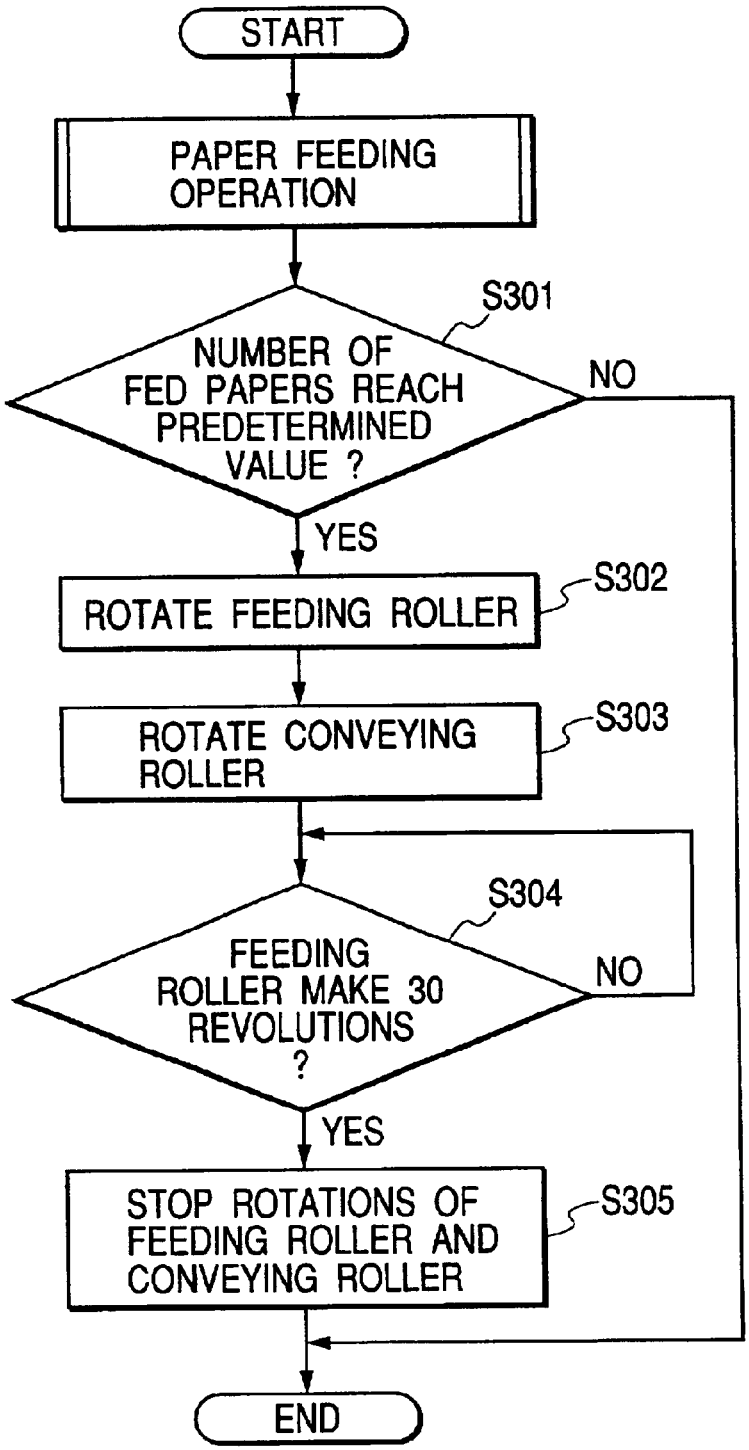
FIG. 13 is a flow chart explaining the cleaning mode of the above described sheet feeding device.

Next, the cleaning mode in the present embodiment will be described below by using a flow chart of FIG. 13.

When the sheet feeding operation is started, the control device 100 determines (S301) whether the number of feeding sheets has reached the predetermined number of sheets based on the number of counts by a number of feeding sheets counter 104 (see FIG. 8). When the number of feeding sheets reaches the predetermined number of sheets (Y of S301), the cleaning mode is automatically performed.

When the cleaning mode is entered in this way, first of all, the sheet feeding roller 28 and the conveying roller 36 are normally rotated (S302, S303). Next, the number of revolutions of the sheet feeding roller 28 is counted by the counter 102, and the sheet feeding roller 28 is rotated for 30 revolutions in the rotational direction of the sheet feeding time. When the sheet feeding roller 28 completes the 30 normal revolutions (Y of S304), the sheet feeding roller 28 and the conveying roller 36 are stopped (S305).

Constituted in this way, the cleaning of the sheet feeding roller can be automatically performed for every predetermined number of sheets and it is therefore possible to prevent the occurrence of the sheet feeding failure in advance. Moreover, the operator is not required to remove the mounted sheet P from the mounting position and it is therefore possible to save time and labor.

Incidentally, in the description made so far, on the occasion of the cleaning mode, as shown in FIG. 10, the description has been made of the case where the sheet feeding roller 28 (sheet feeding roller rubber 282) is sliderably moved over the separating pad 241 and the separating sheet 234, the present invention is not limited to this, but, depending on the arrangement and the like, the sheet feeding roller 28 may be sliderably moved over either one of the separating pad 241 and the separating sheet 234.

As described above, according to the present embodiment, on the occasion of the cleaning mode, the sheet feeding means for delivering the sheets mounted on the sheet mounting means is abutted against at least either one of a first separating member and a second separating member and is rotated for the predetermined number of revolutions so that a conveying force of the sheet feeding means can be maintained without using other/special part. Also, in this way, the sheet feeding failure can be prevented.

What is claimed is:

1. A sheet feeding device, comprising:

a pressure plate for mounting sheets;

a sheet feeding roller for sending out the sheets mounted on said pressure plate;

a separating sheet disposed at a position on said pressure plate, opposite to said sheet feeding roller; and separating means for separating the sheets, wherein said device has a cleaning mode for cleaning a surface of said sheet feeding roller, by causing said sheet feeding roller to contact said pressure plate and thereby rotate, in a situation where no sheet is mounted on said pressure plate.

2. The sheet feeding device according to claim 1, wherein said separating sheet has a large number of hollows on a surface thereof.

3. The sheet feeding device according to claim 1, wherein said separating sheet has hardness capable of cleaning the surface of said sheet feeding roller.

4. The sheet feeding device according to claim 1, wherein said sheet feeding roller is rotated intermittently so as to clean a surface of the sheet feeding roller.

5. The sheet feeding device according to claim 1, further comprising manual setting means for manually setting said cleaning mode.

6. The sheet feeding device according to claim 1, further comprising predetermined number setting means for setting said cleaning mode for every predetermined number of feeding sheets.

7. A sheet feeding device, comprising:

a pressure plate for mounting sheets;

a sheet feeding roller for sending out the sheets mounted on said pressure plate;

a separating sheet disposed at a position on said pressure plate, opposite to said sheet feeding roller; and a separating pad for separating the sheets, wherein said device has a cleaning mode for cleaning a surface of said sheet feeding roller, by causing said sheet feeding roller to contact said separating sheet and said separating pad and thereby rotate, in a situation where no sheet is mounted on said pressure plate.

8. The sheet feeding device according to claim 7, wherein said separating sheet is disposed in the end portion in a sheet feeding direction of said pressure plate, said pressure plate is a first pressure plate and said separating sheet is attached to a second pressure plate which pushes down the sheet mounted on the first pressure plate.

9. The sheet feeding device according to claim 7, wherein at least one of said separating sheet and said separating pad has a large number of hollows on the surface.

10. The sheet feeding device according to claim 7, wherein at least one of said sheet separating and said separating pad has hardness capable of cleaning the surface of said sheet feeding means.

11. The sheet feeding device according to claim 7, wherein said sheet feeding roller is intermittently rotated so as to clean a surface of said sheet feeding roller.

12. The sheet feeding device according to claim 7, further comprising manual setting means for manually setting said cleaning mode.

13. The sheet feeding device according to claim 7, further comprising predetermined number setting means for setting cleaning mode for every predetermined number of feeding sheets.

14. An image forming apparatus for forming an image on a sheet by a recording head, comprising:

a head mounting portion for mounting a recording head;

a pressure plate for mounting sheets;

a sheet feeding roller for sending out the sheets mounted on said pressure plate; and a separating sheet disposed at a position on said pressure plate, opposite to said sheet feeding roller; and separating means for separating the sheets;

wherein said device has a cleaning mode for cleaning a surface of said sheet feeding roller, by causing said sheet feeding roller to contact said pressure plate and thereby rotate, in a situation where no sheet is mounted on said pressure plate.

15. An image forming apparatus for forming an image on a sheet by a recording head, comprising:

a head mounting portion for mounting a recording head;

a pressure plate for mounting the sheets;

a sheet feeding roller for sending out the sheets mounted on said pressure plate;

a separating sheet disposed at a position on said pressure plate, opposite to said sheet feeding roller; and a separating pad for separating the sheets, wherein said device has a cleaning mode for cleaning a surface of said sheet feeding roller, by causing said sheet feeding roller to contact said separating sheet and said separating pad and thereby rotate, in a situation where no sheet is mounted on said pressure plate.

* * * * *

UNITED STATES PATENT AND TRADEMARK OFFICE

CERTIFICATE OF CORRECTION

PATENT NO. : 6,877,737 B2
DATED : April 12, 2005
INVENTOR(S) : Haruyuki Yanagi et al.

It is certified that error appears in the above-identified patent and that said Letters Patent is hereby corrected as shown below:

Column 1,
Line 10, “provide” should read -- provided --.

Column 6,
Line 23, “maintain” should read -- maintains --.

Column 14,
Line 24, “sheet separating” should read -- separating sheet --.

Signed and Sealed this

Thirtieth Day of August, 2005

JON W. DUDAS
*Director of the United States Patent and Trademark Office*